US010759453B1

(12) United States Patent
Ayala et al.

(10) Patent No.: US 10,759,453 B1
(45) Date of Patent: Sep. 1, 2020

(54) MULTI-PURPOSE TOOL SYSTEM

(71) Applicant: Big Stik Manufacturing, Inc., Ocala, FL (US)

(72) Inventors: Orlando Ayala, Riverview, FL (US); Ricardo Cuyar, Riverview, FL (US)

( * ) Notice: Subject to any disclaimer, the term of this patent is extended or adjusted under 35 U.S.C. 154(b) by 80 days.

(21) Appl. No.: 15/631,338

(22) Filed: Jun. 23, 2017

Related U.S. Application Data

(60) Provisional application No. 62/435,982, filed on Dec. 19, 2016.

(51) Int. Cl.

| | |
|---|---|
| ***B25B 23/16*** | (2006.01) |
| ***B25G 1/04*** | (2006.01) |
| ***B61L 7/02*** | (2006.01) |
| ***B63H 25/20*** | (2006.01) |
| *B61K 5/02* | (2006.01) |
| *B63B 21/00* | (2006.01) |

(52) U.S. Cl.
CPC ..... *B61L 7/027* (2013.01); *B25B 23/16* (2013.01); *B25G 1/04* (2013.01); *B61L 7/021* (2013.01); *B63H 25/20* (2013.01); *B61K 5/02* (2013.01); *B63B 2021/007* (2013.01)

(58) Field of Classification Search
CPC ..... B61L 7/027; B61L 7/021; B63H 25/20; B61K 5/02; B63B 2021/007; B25G 1/043; B25G 1/005; B25G 1/04; B25G 3/12; B25G 3/00; B25B 23/0021; B25B 23/0035; B25B 13/481; B25B 23/16; F16B 7/10; F16B 21/00; A01K 97/10; A47F 5/00
See application file for complete search history.

(56) References Cited

U.S. PATENT DOCUMENTS

| | | | | |
|---|---|---|---|---|
| 684,858 A | | 10/1901 | Pearson | |
| 872,271 A | | 10/1907 | Benet | |
| 918,579 A | | 4/1909 | Murch | |
| 1,345,027 A | * | 6/1920 | Rippe | E04F 10/0648 81/484 |
| 1,365,851 A | | 1/1921 | Reynolds | |
| 1,726,372 A | | 8/1929 | Stoll | |
| 2,837,381 A | * | 6/1958 | Sarlandt | B25G 1/10 403/263 |

(Continued)

FOREIGN PATENT DOCUMENTS

| | | |
|---|---|---|
| DE | 202004010326 A1 | 11/2004 |
| GB | 2413518 A1 | 11/2005 |

OTHER PUBLICATIONS

U.S. Appl. No. 13/616,293, Robert G. Lofley, Sr., et al.

(Continued)

*Primary Examiner* — Robert J Scruggs

(57) ABSTRACT

A handle section has an interior tube slidably received in an exterior tube. A locking mechanism is secured to the exterior tube and includes a cylindrical finger reciprocable between an unlocking position and a locking position to allow for lengthening and shortening. A head is coupled to the interior tube. The head has a central tube formed as an extension of the interior tube. The head has a first wing with a first upper edge extending horizontally across the first wing. The first wing has a first outer edge extending vertically from the first wing parallel with and spaced from the central tube. The first wing has a first lower edge extending in a major arc between the first outer edge and the central tube.

4 Claims, 5 Drawing Sheets

(56) References Cited

U.S. PATENT DOCUMENTS

| | | | | |
|---|---|---|---|---|
| 4,076,213 | A | 2/1978 | Payson | |
| 4,352,381 | A * | 10/1982 | Provi | B25G 3/34 30/308.1 |
| 4,577,837 | A | 3/1986 | Berg et al. | |
| 4,646,378 | A | 3/1987 | Borden | |
| 4,715,252 | A | 12/1987 | Pella | |
| 4,918,896 | A | 4/1990 | Wiese | |
| 4,991,469 | A | 2/1991 | Pella | |
| 5,141,353 | A * | 8/1992 | Meredith, Jr. | B25G 1/10 294/57 |
| 5,433,551 | A | 7/1995 | Gordon | |
| 5,481,950 | A | 1/1996 | Browning | |
| 5,625,923 | A | 5/1997 | Huang | |
| 5,811,688 | A | 9/1998 | Marsh et al. | |
| 6,182,539 | B1 | 2/2001 | Webster | |
| 6,213,672 | B1 | 4/2001 | Varga | |
| 6,254,305 | B1 | 7/2001 | Taylor | |
| 6,347,777 | B1 | 2/2002 | Webber | |
| 6,461,074 | B2 | 10/2002 | Taylor | |
| 6,682,209 | B2 | 1/2004 | Drake et al. | |
| 6,951,185 | B1 | 10/2005 | Wiese | |
| 7,025,015 | B2 | 4/2006 | Wilcox et al. | |
| 7,040,832 | B2 | 5/2006 | Hsieh | |
| 7,097,380 | B2 | 8/2006 | Lee | |
| 7,111,574 | B2 | 9/2006 | Slatter | |
| 7,188,553 | B1 | 3/2007 | Pryor | |
| 7,293,934 | B1 | 11/2007 | Huang | |
| 7,311,061 | B1 | 12/2007 | Wiese | |
| 7,774,901 | B1 | 8/2010 | Huang | |
| 7,934,441 | B1 * | 5/2011 | Hyde | B25B 13/463 7/143 |
| D663,193 | S | 7/2012 | Lofley, Sr. et al. | |
| D676,735 | S | 2/2013 | Lofley, Sr. et al. | |
| 8,434,802 | B2 * | 5/2013 | Lofley, Sr. | B25G 1/04 294/175 |
| 8,469,425 | B1 | 6/2013 | Lofley, Sr. et al. | |
| 8,469,426 | B2 | 6/2013 | Lofley, Sr. et al. | |
| 8,939,051 | B1 | 1/2015 | Lofley, Sr. et al. | |
| 9,358,674 | B2 * | 6/2016 | Lasaga | B25C 11/00 |
| D760,564 | S | 7/2016 | Lofley, Sr. et al. | |
| D786,638 | S | 5/2017 | Lofley, Sr. et al. | |
| D843,183 | S | 3/2019 | Lofley, Sr. et al. | |
| 2004/0016385 | A1 | 1/2004 | Wilcox et al. | |
| 2006/0062632 | A1 | 3/2006 | Jang | |
| 2006/0150779 | A1 * | 7/2006 | Rider | B25D 1/00 81/53.1 |
| 2010/0005934 | A1 * | 1/2010 | Guilbault | B25F 1/02 81/177.2 |
| 2016/0052121 | A1 * | 2/2016 | Smith | B25F 1/006 7/146 |
| 2016/0066973 | A1 * | 3/2016 | Borries | A61B 17/92 606/100 |

OTHER PUBLICATIONS

U.S. Appl. No. 13/757,482, Robert G. Lofley, Sr., et al.
U.S. Appl. No. 13/834,674, Robert G. Lofley, Sr., et al.
U.S. Appl. No. 13/837,198, Robert G. Lofley, Sr., et al.
U.S. Appl. No. 12/567,135, Ricardo Cuyar.
U.S. Appl. No. 13/926,127, Robert G. Lofley, Sr., et al.
U.S. Appl. No. 13/926,168, Robert G. Lofley, Sr., et al.
U.S. Appl. No. 14/206,040, Robert G. Lofley, Sr., et al.
U.S. Appl. No. 14/206,659, Robert G. Lofley, Sr., et al.
U.S. Appl. No. 14/278,806, Robert G. Lofley, Sr., et al.
U.S. Appl. No. 14/605,442, Robert G. Lofley, Sr., et al.
U.S. Appl. No. 16/536,955, Robert G. Lofley, Jr.
www.alltackle.com/rupp_big_riggs_ruppriggers.htm.
www.paint-and-supplies.hardwarestore.com/47-345-extension-poles/z-pro-telescoping-extension-pole-453423.aspx.

* cited by examiner

FIG. 3
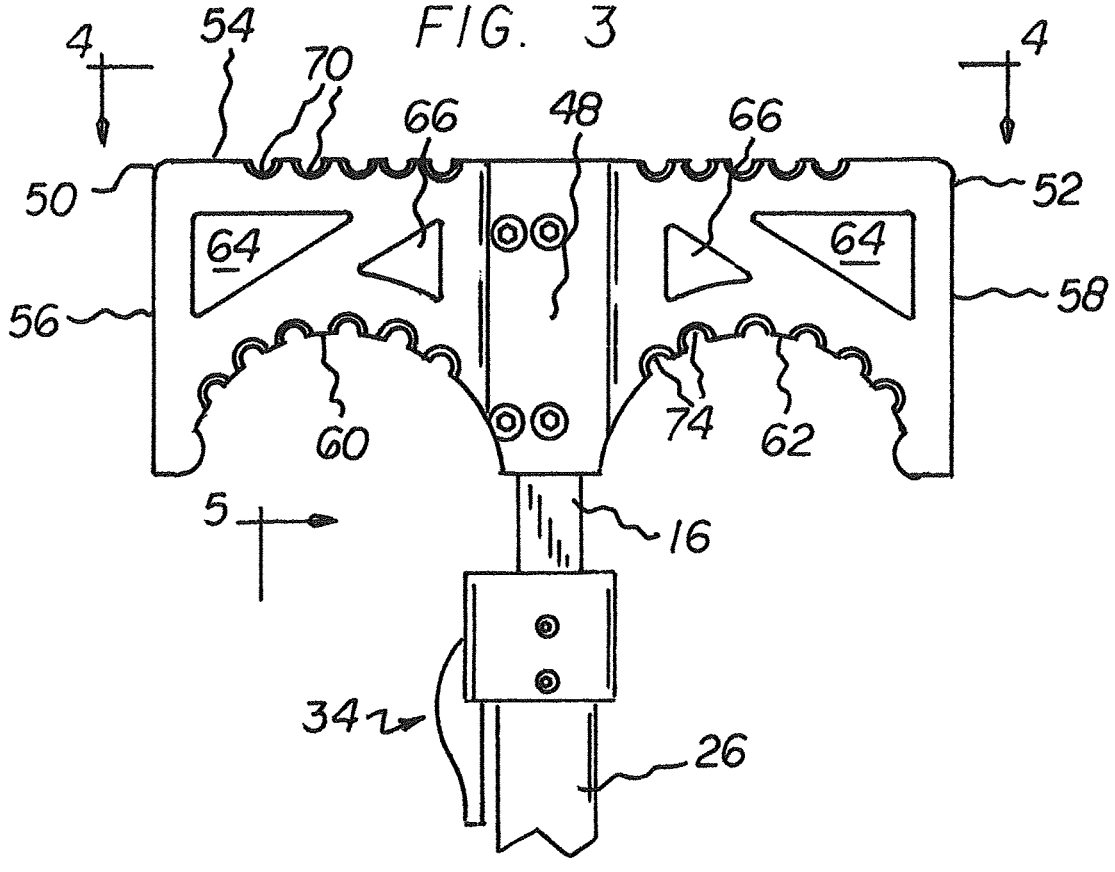
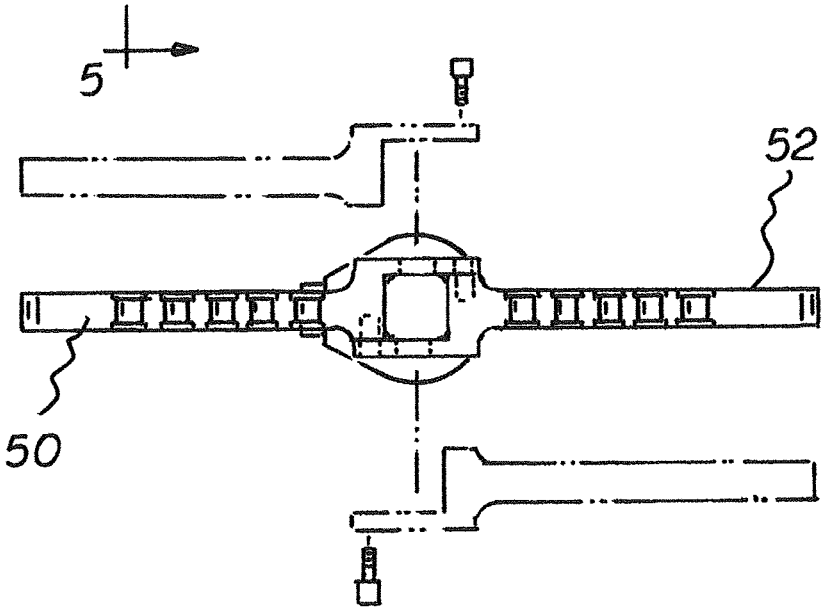
FIG. 4

MULTI-PURPOSE TOOL SYSTEM

RELATED APPLICATION

The present application is based upon Provisional Application No. 62/435,982 filed Dec. 19, 2016, the subject matter of which is incorporated herein by reference and the priority of which is hereby claimed.

BACKGROUND OF THE INVENTION

Field of the Invention

The present invention relates to a multi-purpose tool system and more particularly pertains to turning brake wheels and other wheels in the railroad industry and retrieving mooring lines in the barge and maritime industry, the turning and the retrieving being done in a safe, convenient, and economical manner.

SUMMARY OF THE INVENTION

In view of the disadvantages inherent in the known types of mooring line retrieval systems now present in the prior art, the present invention provides an improved multi-purpose tool system. As such, the general purpose of the present invention, which will be described subsequently in greater detail, is to provide a new and improved multi-purpose tool system and method which has all the advantages of the prior art and none of the disadvantages.

From a broad perspective, the present invention essentially comprises a handle section. The handle section has an interior tube. The handle section also has an exterior tube. The interior tube is slidably received in the exterior tube. A locking mechanism is provided. The locking mechanism is secured to the exterior tube. The locking mechanism includes a cylindrical finger. The cylindrical finger is reciprocable between an unlocking position and a locking position. In this manner the handle section may be lengthen and shortened. Further provided is a head. The head is coupled to the interior tube. The head has a central tube. The central tube is formed as an extension of the interior tube. The head has a wing. The wing has a first upper edge extending horizontally across the wing. The wing has an outer edge extending vertically from the wing parallel with and spaced from the central tube. The wing has a lower edge extending in a major arc between the outer edge and the central tube.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved turning and retrieving system which has all of the advantages of the prior art turning and retrieving systems and none of the disadvantages.

It is another object of the present invention to provide a new and improved multi-purpose tool system which may be easily and efficiently manufactured and marketed.

It is a further object of the present invention to provide a new and improved multi-purpose tool system which is of durable and reliable constructions.

An even further object of the present invention is to provide a new and improved multi-purpose tool system which is susceptible of a low cost of manufacture with regard to both materials and labor, and which accordingly is then susceptible of low prices of sale to the consuming public, thereby making such multi-purpose tool system economically available to the railroad and barge and maritime industries.

Lastly, another object of the present invention is to provide a multi-purpose tool system for turning brake wheels and other wheels in the railroad industry and retrieving mooring lines in the barge and maritime industry. The turning and the retrieving are done in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an enlarged illustration of the head section of the system of FIGS. 1 and 2.

FIG. 4 is a plan view taken along line 4-4 of FIG. 3.

The same reference numerals refer to the same parts throughout the various Figures.

DESCRIPTION OF THE PREFERRED EMBODIMENT

Figure 1:
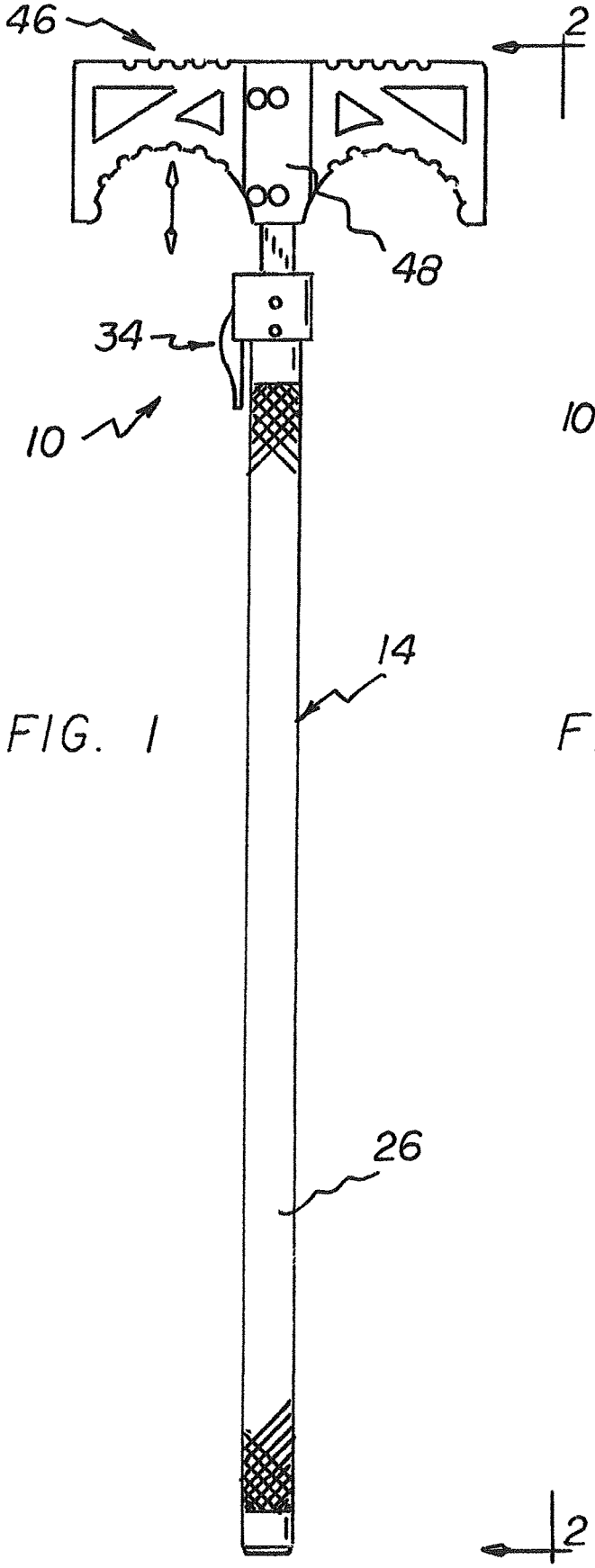
FIG. 1 is a front elevational view of a multi-purpose tool constructed in accordance with the principles of the present invention.
Figure 2:
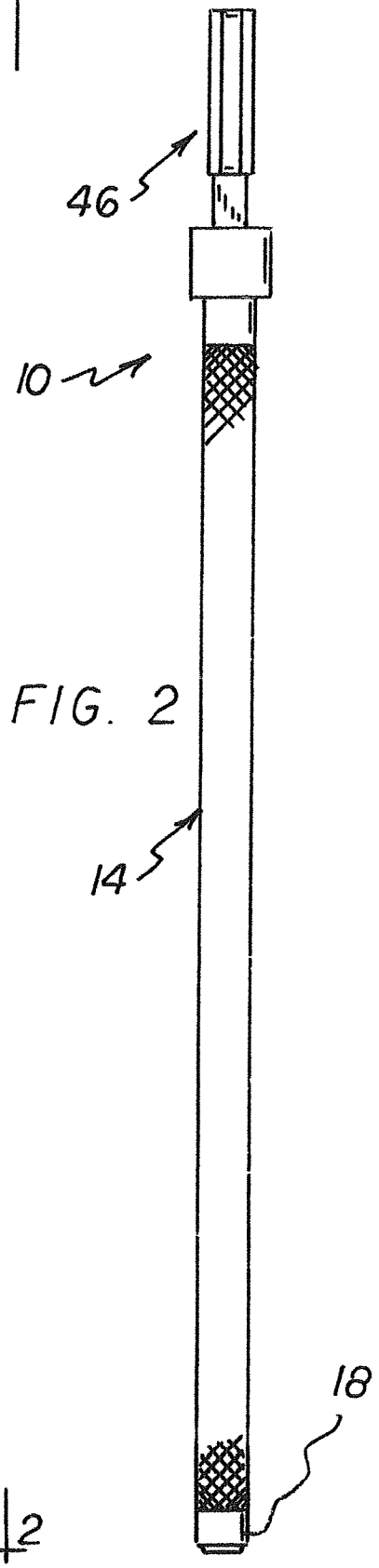
FIG. 2 is a side elevational view taken along line 2-2 of FIG. 1.

With reference now to the drawings, and in particular to FIG. 1 thereof, the preferred embodiment of the new and improved multi-purpose tool system embodying the principles and concepts of the present invention and generally designated by the reference numeral 10 will be described.

The present invention, the multi-purpose tool system 10 is comprised of a plurality of components. Such components in their broadest context include a handle, a locking system, and a head. Such components are individually configured and correlated with respect to each other so as to attain the desired objective.

First provided is a handle section 14. The handle section has an interior tube 16. The interior tube has a closed proximal end 18. The interior tube has an open distal end 20. The interior tube has a hollow chamber. The hollow chamber is provided between the closed end and the open distal end. The interior tube in a square cross sectional configuration. The interior tube has one lateral face. The lateral face has a plurality of axially spaced apertures 22.

The handle section 14 also has an exterior tube 26. The exterior tube has a closed proximal end 28. The exterior tube has an open distal end 30. A hollow chamber is provided is between the closed end and the open distal end. The exterior tube has a square cross sectional configuration interiorly. The exterior tube has knurled circular cross sectional configuration exteriorly. The interior tube is slidably received in the chamber of the exterior tube.

Figure 5:
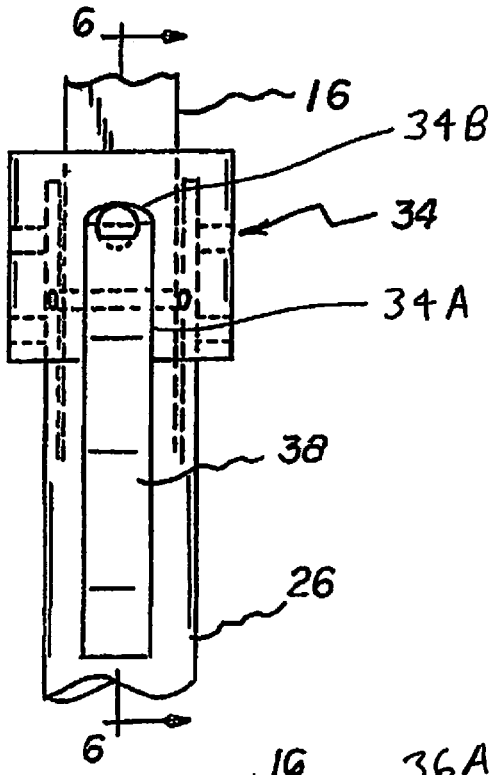
FIG. 5 is an exploded side elevational view taken along line 5-5 of FIG. 3.
Figure 6:
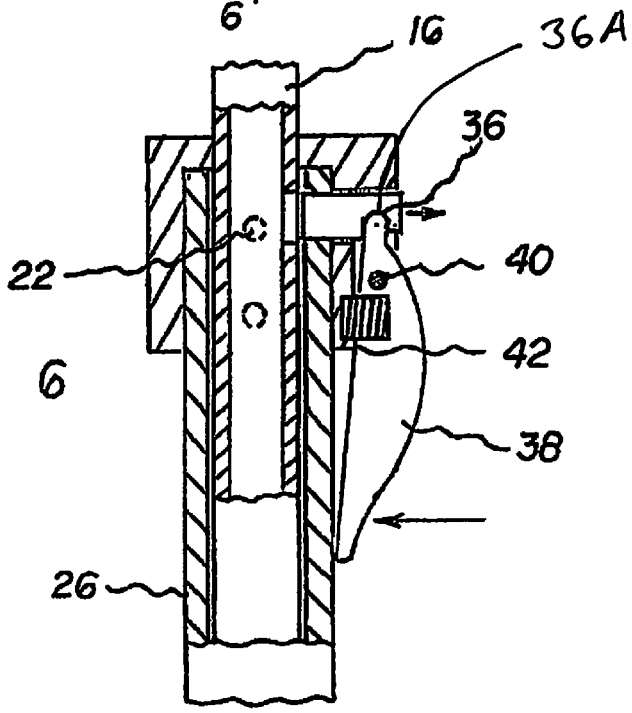
FIG. 6 is a cross sectional view taken along line 6-6 of FIG. 5.
Figure 7:
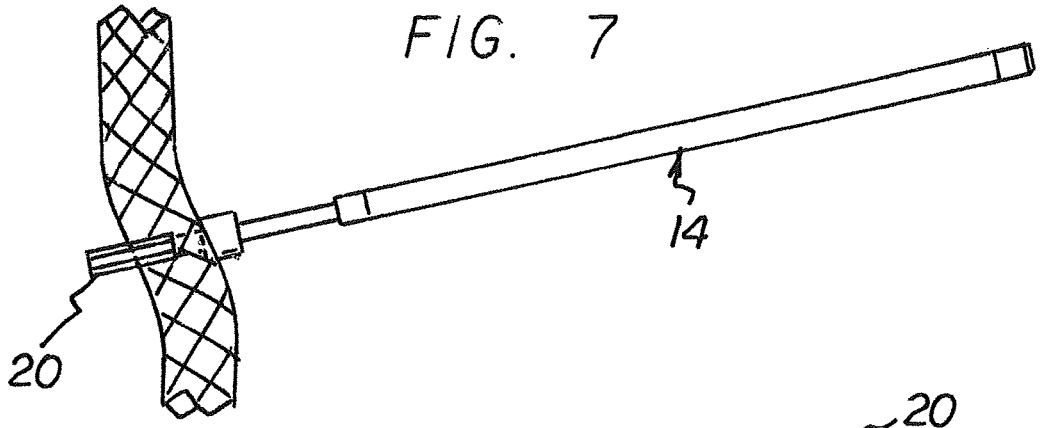
FIG. 7 is a perspective showing of the system of the prior Figures.
Figure 8:
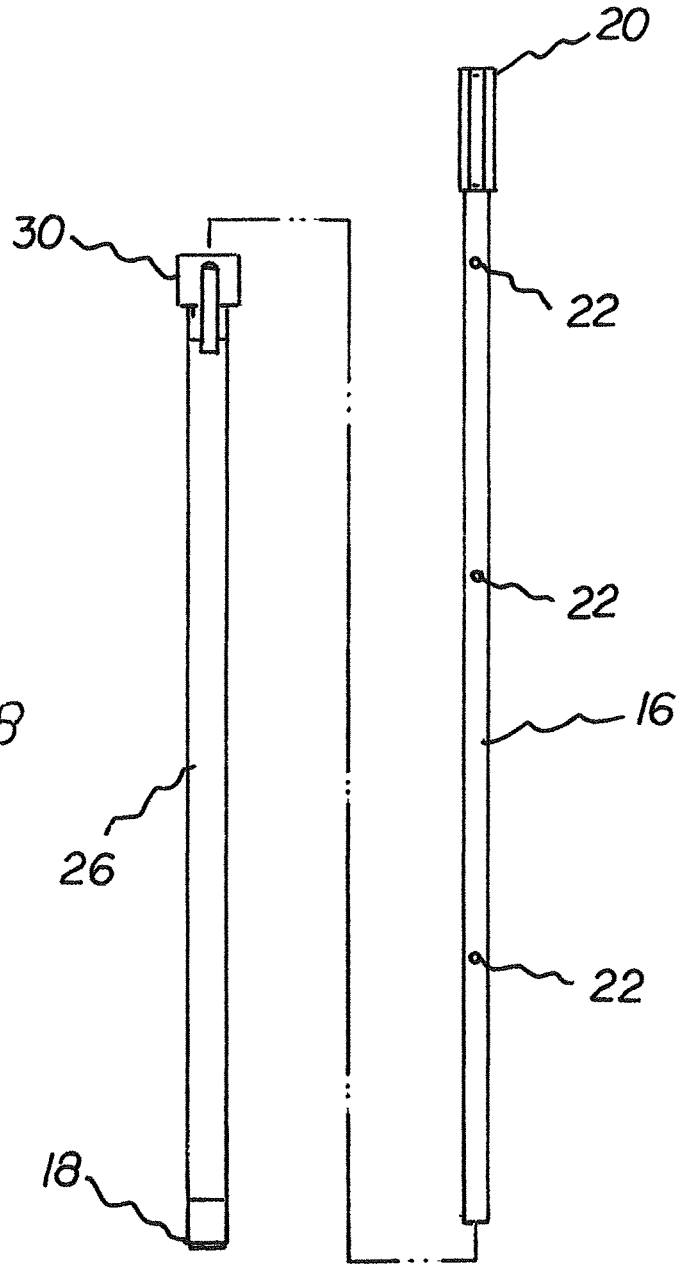
FIG. 8 is an exploded illustration of the system of the prior Figures.

A locking mechanism 34 is provided. The locking mechanism is secured to the open distal end of the exterior tube. The locking mechanism has a cylindrical finger 36. The cylindrical finger is radially reciprocable between an unlocking position remote from the interior tube and a locking position within a preselected aperture. In this manner the handle section may be lengthened and shortened. The locking mechanism includes a rocker 38. The rocker has an upper end. The rocker has a lower end. The rocker has a pivot point 40. The pivotal point is provided between the upper end and the lower end. The upper end is operatively coupled to the cylindrical finger. More specifically as shown in FIGS. 5 and 6, the cylindrical finger 36 includes a groove 36A. The upper end of the rocker 38 continuously engages within the groove 36A and displaces the cylindrical finger 36 during reciprocating between the unlocking position and the locking position. In this manner the locking mechanism may be moved between the locking and unlocking positions. The lower end is adapted to be manipulated by a user. In this manner the cylindrical finger may be moved. The locking further includes a coil spring 42. The coil spring urges the rocker to the locking position. As shown in FIGS. 5 and 6, the locking mechanism 34 further includes a channel 34A having an upper arcuate wall portion 34B. The cylindrical finger 36 slides within the channel 34A. The cylindrical finger 36 engages with the rocker 38. The channel and the rocker 38 guide the cylindrical finger 36 reciprocating between the unlocking position and the locking position.

Provided next is a head 46. The head is coupled to the open distal end of the interior tube. The head has a central tube 48. The central tube is formed as an extension of the interior tube. The central tube has a first wing 50. The central tube has a similarly configured second wing 52. The head has an upper edge 54. The upper edge extends horizontally across the first wing and the second wing. The head has a first outer edge 56. The lower edge extends vertically. The first wing is parallel with and spaced from the central tube. The head has a second outer edge 58. The second outer edge extends vertically from the second wing. The second outer edge is parallel with and spaced from the central tube. The head has a first lower edge 60. The first lower edge extends in a major arc between the first outer edge and the central tube. The head has a second lower edge 62. The second lower edge extends in a major arc between the second outer edge and the central tube. The first wing and the second wing each have a plurality of triangular cut outs 64, 66. In this manner weight and cost are reduced. Further in this manner movement of the head in water is facilitated.

Further provided is a plurality upper notches 70. The upper notches are provided in the upper edge. In this manner securing contact with brake wheels and other wheels in the railroad industry is facilitated. A plurality lower notches 74 is also provided. The lower notches are provided in the lower edge. In this manner secure contact with ropes in the barge and maritime industry are facilitated. The upper and lower notches all have a radius of curvature of 0.125 inches, plus or minus 20 percent.

Figure 9:
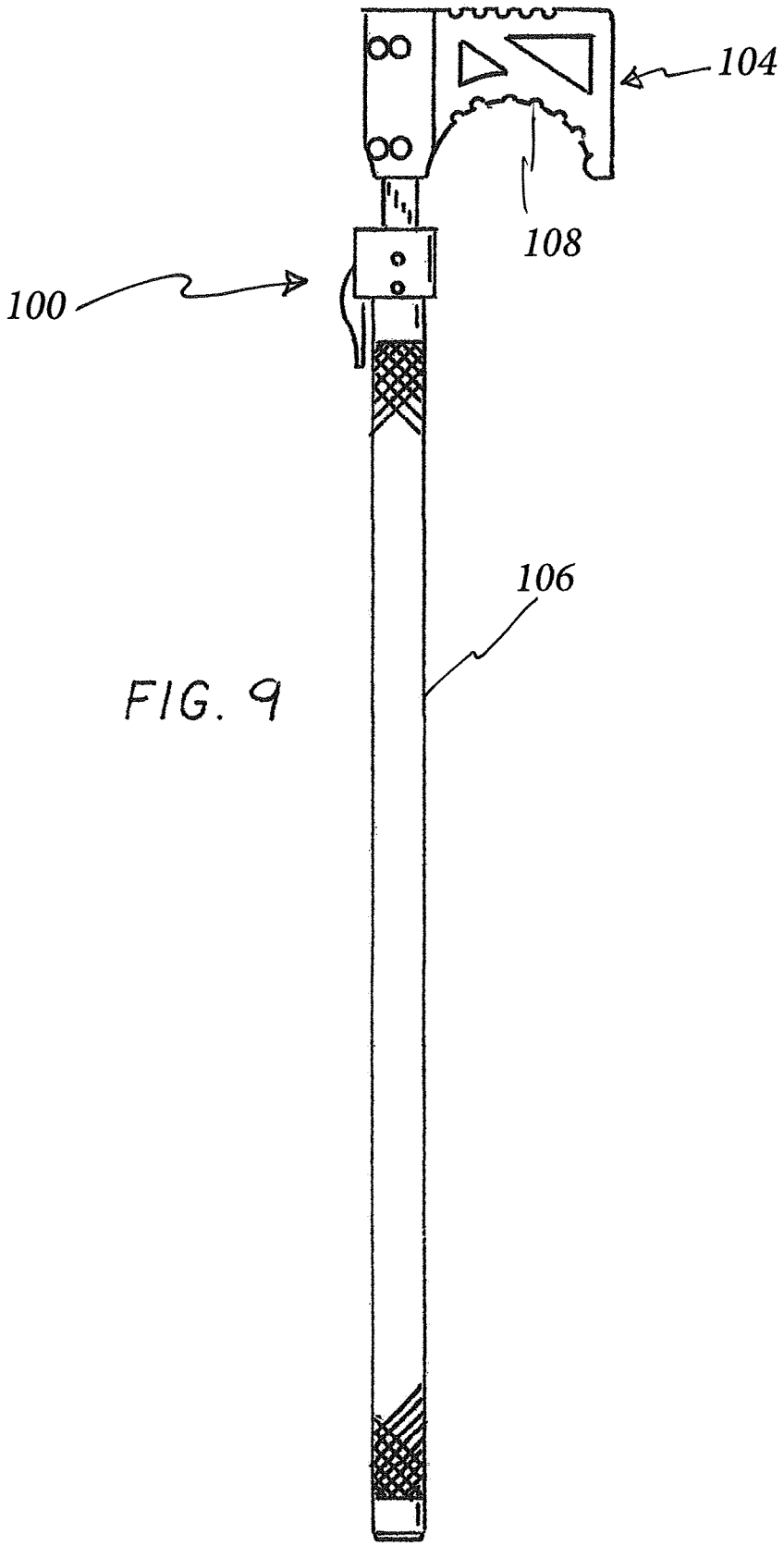
FIG. 9 is a front elevational view illustrating an alternate embodiment of the invention.

An alternate embodiment of the present invention 100 is shown in FIG. 9 which illustrates the handle 106, the head 104, and the wing which, in this embodiment, is a single wing 108.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A multi-purpose tool system for engaging an object, comprising:

a handle section having an interior tube and an exterior tube, wherein said interior tube slidably received in said exterior tube;

a head coupled to said interior tube for engaging the object;

a locking mechanism secured to said exterior tube including:

a rocker pivoting relative to a channel;

said channel having an upper arcuate wall portion;

a cylindrical finger within said channel and reciprocating between an unlocking position and a locking position for lengthening and shortening said handle section;

said channel and said rocker guiding said cylindrical finger reciprocating between said unlocking position and said locking position;

said rocker having an upper end and a lower end and a pivot point there between for pivotably coupling said rocker within said channel;

a rocker couple defined by said upper end of said rocker engaging with said cylindrical finger for movement between said unlocking position and said locking position;

said rocker couple including said upper end of said rocker engaging continuously within a groove within said cylindrical finger for displacing the cylindrical finger during reciprocating between the unlocking position and the locking position; and said lower end of said rocker adapted to be manipulated to move said cylindrical finger between said unlocking position and said locking position.

2. The multi-purpose tool system as set forth in claim 1, further including a coil spring urging the rocker to the locking position.

3. The multi-purpose tool system as set forth in claim 1, wherein said head includes a first head and a second head defining a generally opposing orientation relative to said interior tube.

4. A multi-purpose tool system for engaging an object, comprising:

a handle section having an interior tube and an exterior tube, wherein said interior tube slidably received in said exterior tube;

a head coupled to said interior tube for engaging the object;

a locking mechanism secured to said exterior tube including:

a rocker pivoting relative to a channel;

a cylindrical finger within said channel and reciprocating between an unlocking position and a locking position for lengthening and shortening said handle section;

said channel and said rocker guiding said cylindrical finger reciprocating between said unlocking position and said locking position;

said rocker having an upper end and a lower end and a pivot point there between for pivotably coupling said rocker within said channel;

a rocker couple defined by said upper end of said rocker engaging with said cylindrical finger for movement between said unlocking position and said locking position;

said rocker couple including said upper end of said rocker engaging continuously within a groove within said cylindrical finger for displacing the cylindrical finger during reciprocating between the unlocking position and the locking position; and said lower end of said rocker adapted to be manipulated to move said cylindrical finger between said unlocking position and said locking position.

* * * * *